US006418759B1

(12) United States Patent
Zeren et al.

(10) Patent No.: US 6,418,759 B1
(45) Date of Patent: Jul. 16, 2002

(54) SLOT ADAPTER

(75) Inventors: Gregory Zeren, Sunnyvale; Glenn Rodgers, San Mateo, both of CA (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/543,610

(22) Filed: Apr. 5, 2000

Related U.S. Application Data

(63) Continuation-in-part of application No. 09/532,382, filed on Mar. 22, 2000.
(60) Provisional application No. 60/128,988, filed on Apr. 12, 1999.

(51) Int. Cl.[7] ..... E05B 69/00
(52) U.S. Cl. ..... 70/58; 70/14; 70/18
(58) Field of Search ..... 70/58, 14, 18, 70/431

(56) References Cited

U.S. PATENT DOCUMENTS 2,383,397 A 8/1945 Lofqwist ..... 70/424
5,493,878 A * 2/1996 Murray, Jr. et al. ..... 70/58
5,787,739 A * 8/1998 Derman ..... 70/58
6,000,251 A 12/1999 Murray, Jr. et al. ..... 70/58
6,000,252 A * 12/1999 Murray, Jr. et al. ..... 70/58
6,006,557 A 12/1999 Carl et al. ..... 70/58
6,038,891 A 3/2000 Zeren et al. ..... 70/58

FOREIGN PATENT DOCUMENTS

WO PCT/US00/28708 10/2000

* cited by examiner

*Primary Examiner*—Yonet Beaulieu
(74) *Attorney, Agent, or Firm*—McCutchen, Doyle, Brown & Enersen, LLP

(57) ABSTRACT

An apparatus for securing a cable to a portable device equipped with a security slot defined within an outer wall. A first member is coupled to a second member with each member having at least one aperture defined within a body portion thereof. A locking member protrudes from a bottom edge of the first member and a pin protrudes from a bottom edge of the second member. The first and second members are movable from an unlocked position wherein the locking member is adapted for insertion into the security slot and engagement with the outer wall, to a locked position wherein the pin slidably abuts the locking member to secure the locking member within the security slot. When the first and second members are in the locked position, the aperture is aligned to allow for passage of the cable.

22 Claims, 9 Drawing Sheets

SLOT ADAPTER

This application is a continuation-in-part application and claims priority from U.S. Provisional Application Serial No. 60/128,988, filed Apr. 12, 1999 and U.S. patent application Ser. No. 09/532,382, filed Mar. 22, 2000, the disclosures of which are incorporated herein by reference.

BACKGROUND OF THE INVENTION

1. Field of the Invention

The present invention relates generally to devices for inhibiting theft of relatively small, but expensive pieces of equipment, and more particularly, to a lock interface that may be used with slots located on the pieces of equipment, regardless of the angle or orientation of the slot.

2. Description of the Prior Art

Computers have evolved rather rapidly from large, expensive machines useable only by a few, to relatively small, portable machines that are useable by many. In particular, the development of desktop computers with significant processing power has made computers available to the general population. It is now common for college and even high school students to have their own computer, and desktop computers are in widespread use as word processors in workstations in almost all forms of business. Desktop computers are relatively small and easily transportable, and an undesirable side effect of their proliferation is the fact that the theft of such computers is a significant problem.

Furthermore, computing and data communications are increasingly being hosted on portable devices. A special class of computers is known as a "laptop" or "notebook" computer. Laptops are generally lightweight, portable computers that are increasingly being used for personal and business computing. Personal hand held electronic devices, such as personal digital assistants, or "PDAs" are also increasingly popular. Further, wireless communication technology has enabled an explosive growth of portable telephones, computers and PDAs. An undesirable side effect of the proliferation of portable devices is that they are more prone to theft and being replaced, as compared to larger non-portable devices such as the desktop computers or telephones connected to a wall by a data line.

A variety of devices have been developed to inhibit the theft of desktop computers, portable electronic devices, and similar equipment. Since desktop computer systems involve several components, typically including the computer itself, a separate monitor, keyboard and often a printer, such security systems often employ a cable that attaches each of the components to each other and to a relatively immovable object such as a desk. The principal difficulty in such systems is providing an effective and convenient method for attaching the cable itself to the equipment. Typically, a slot or security hole is defined within an outer wall of each component. Likewise, many portable devices today include such security holes. Such security holes provide an interface for a locking device to which a cable or padlock, or other locking mechanisms, may be attached for securing each component or the portable device from theft or being lost.

Generally, existing locking devices are generally too inefficient or ineffective, or their application is too limited. For example, depending upon the angular orientation of the security hole, various locking devices may not be used.

SUMMARY OF THE INVENTION

In accordance with the present invention, an apparatus for securing a cable to a device equipped with a security slot defined within an outer wall includes a first member, a second member coupled to the first member, a locking member protruding from a bottom edge of the first member, and a pin protruding from a bottom edge of a second member. The first and second members have complementary shapes and each have at least one aperture defined within a body portion of the respective first and second members. The first and second members are movable from an unlocked position wherein the locking member is adapted for insertion into the security slot and engagement with the outer wall, to a locked position wherein the pins slideably abuts the locking member to secure the locking member within the security slot and the aperture is aligned to provide a passage for the cable.

In accordance with one aspect of the present invention, the first member and the second member each have a first face and a second face with a generally right-angle fold therebetween, and wherein the second member is slideably rests within the first member.

In accordance with a further aspect of the present invention, the first and second faces of the first and second members each include an aperture and the pairs of apertures are configured to align in the locked position.

In accordance with another aspect of the present invention, the first member includes a vertical channel and the second member includes a rivet slideably arranged within the channel which attaches the second member to the first member.

The present invention also provides a method of securing a portable device equipped with a security slot defined within an outer wall. The method includes providing a cable and an apparatus for securing the cable to the portable device. The apparatus includes a device equipped with a security slot defined within an outer wall includes a first member, a second member coupled to the first member, a locking member protruding from a bottom edge of the first member, and a pin protruding from a bottom edge of a second member. The first and second members have complementary shapes and each have at least one aperture defined within a body portion of the respective first and second members. The first and second members are movable from an unlocked position wherein the locking member is adapted for insertion into the security slot and engagement with the outer wall, to a locked position wherein the pins slideably abuts the locking member to secure the locking member within the security slot and the aperture is aligned to provide a passage for the cable.

The method further includes placing the locking member into the slot and rotating the apparatus 90°. The second member is then moved relative to the first member such that the pin extends into the slot and the apertures defined in the first and second members are aligned. The cable is then placed through the apertures and is secured to a substantially stationary device.

Other features and advantages of the present invention will be understood upon reading and understanding the detailed description of the preferred exemplary embodiments, found hereinbelow, in conjunction with reference to the drawings, in which like numerals represent like elements.

DETAILED DESCRIPTION OF THE PREFERRED EXEMPLARY EMBODIMENTS

Figure 1:
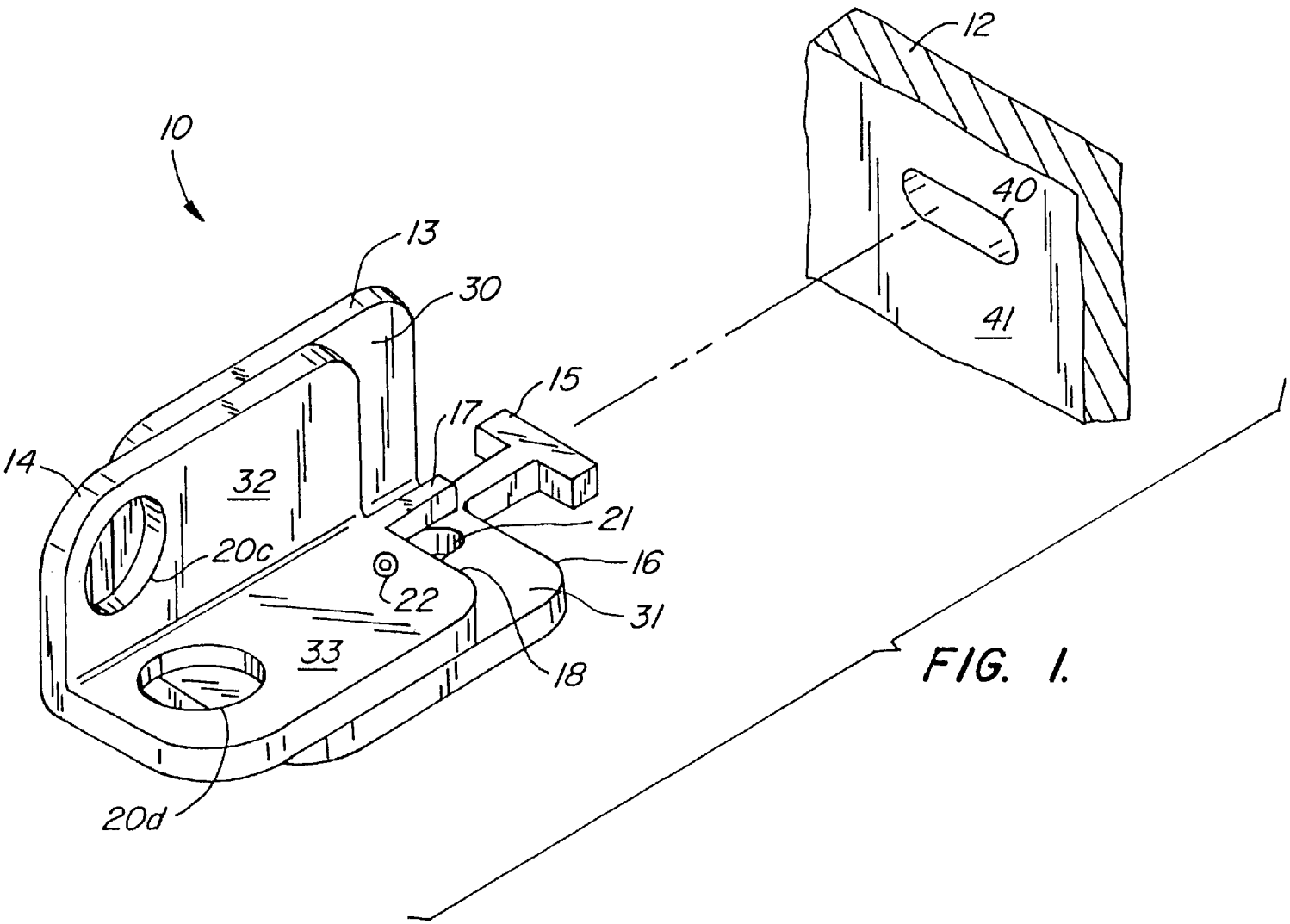
FIG. 1 is an exploded perspective view of a locking apparatus in an unlocked position in accordance with the present invention prior to engaging a security slot.

An apparatus 10 for securing a cable 11 to a portable device 12, such as a laptop computer or a PDA, or a component of a desktop computer system, or any other type of device that one wishes to secure, includes a first or outer member 13 and a second or inner member 14 coupled thereto. A locking member 15 protrudes from a bottom edge 16 of the first member while a pin 17 protrudes from a bottom edge 18 of the second member. Preferably, the locking member is substantially T-shaped while the pin is substantially straight.

Figure 7:
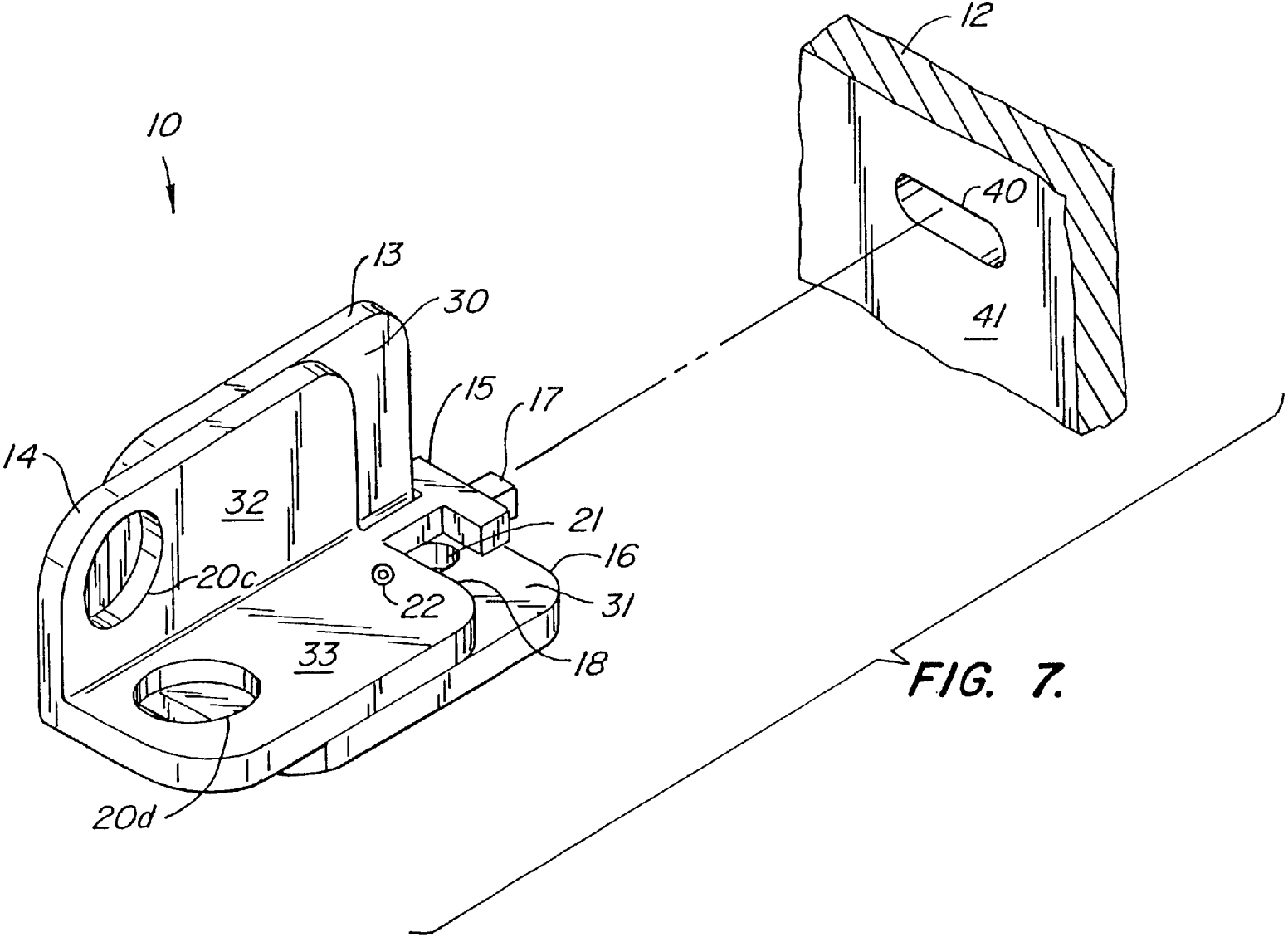
FIG. 7 is an exploded perspective view of a preferred alternative embodiment of a locking apparatus in an unlocked position in accordance with the present invention prior to engaging a security slot.
Figure 8:
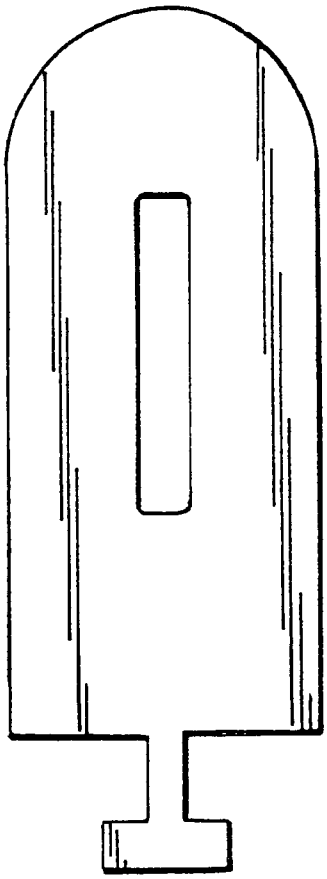
FIGS. 8–17 illustrate an alternative embodiment of a locking apparatus in accordance with the present invention.
Figure 9:
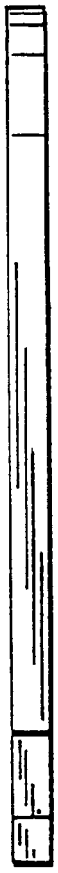
Figure 10:
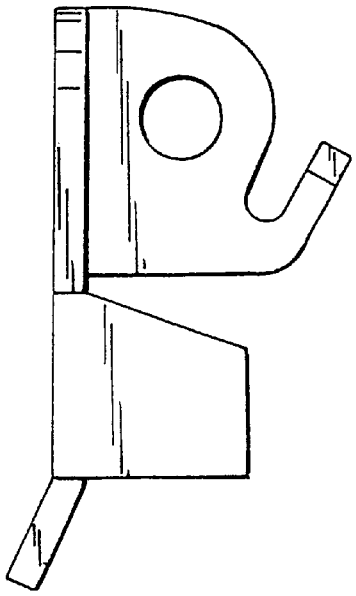
Figure 11:
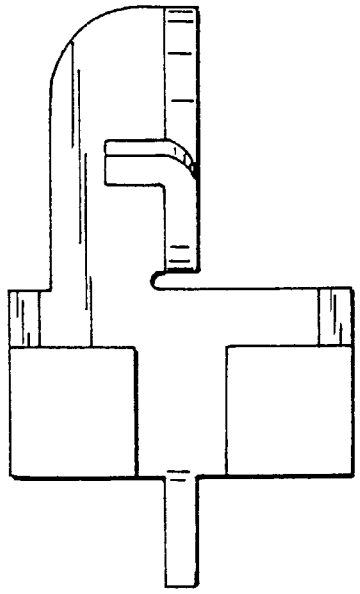
Figure 12:
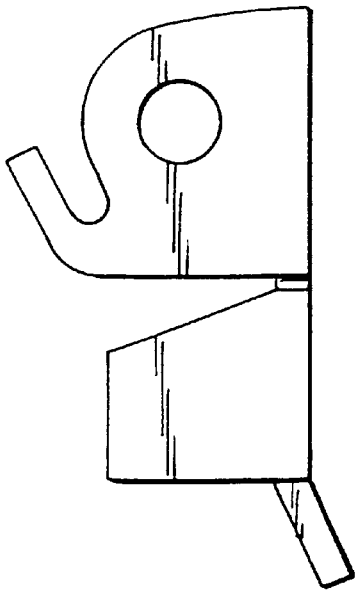
Figure 13:
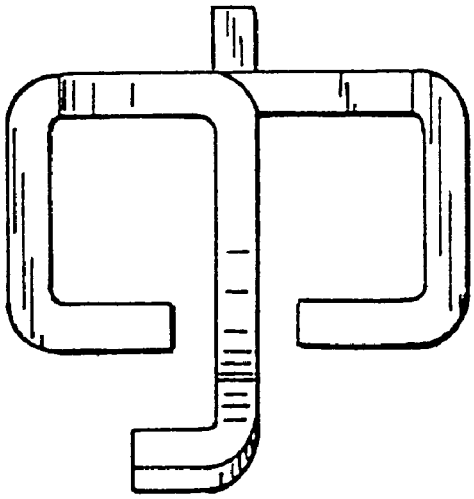
Figure 14:
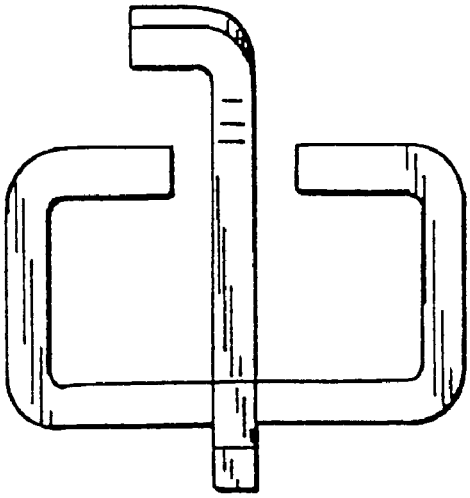

In an preferred alternative embodiment illustrated in FIG. 7, locking member 15 protrudes from bottom edge 18 of the second member while pin 17 protrudes from bottom edge 16 of the first member.

Both the first member and the second member include apertures 20 defined therein.

As noted above, the first and second members are coupled to one another. Preferably, this is accomplished with a slot or groove 21 defined within the first member and a rivet 22 coupled to the second member that is slideably arranged within the slot or groove. This allows relative movement between the first member and the second member.

In accordance with a preferred embodiment, both the first or outer member and the second or inner member each have a substantially 90° bend. Hence, the first member includes a first face 30 and a second face 31 with a generally right-angle fold therebetween, and likewise, the second member includes a first face 32 and a second face 33 with a generally right-angle fold therebetween. Thus, the second member slideably rests within the first member.

Additionally, both the first and second faces of the first and second members each include an aperture 20*a*, 20*b*, 20*c*, 20*d*.

Figure 2:
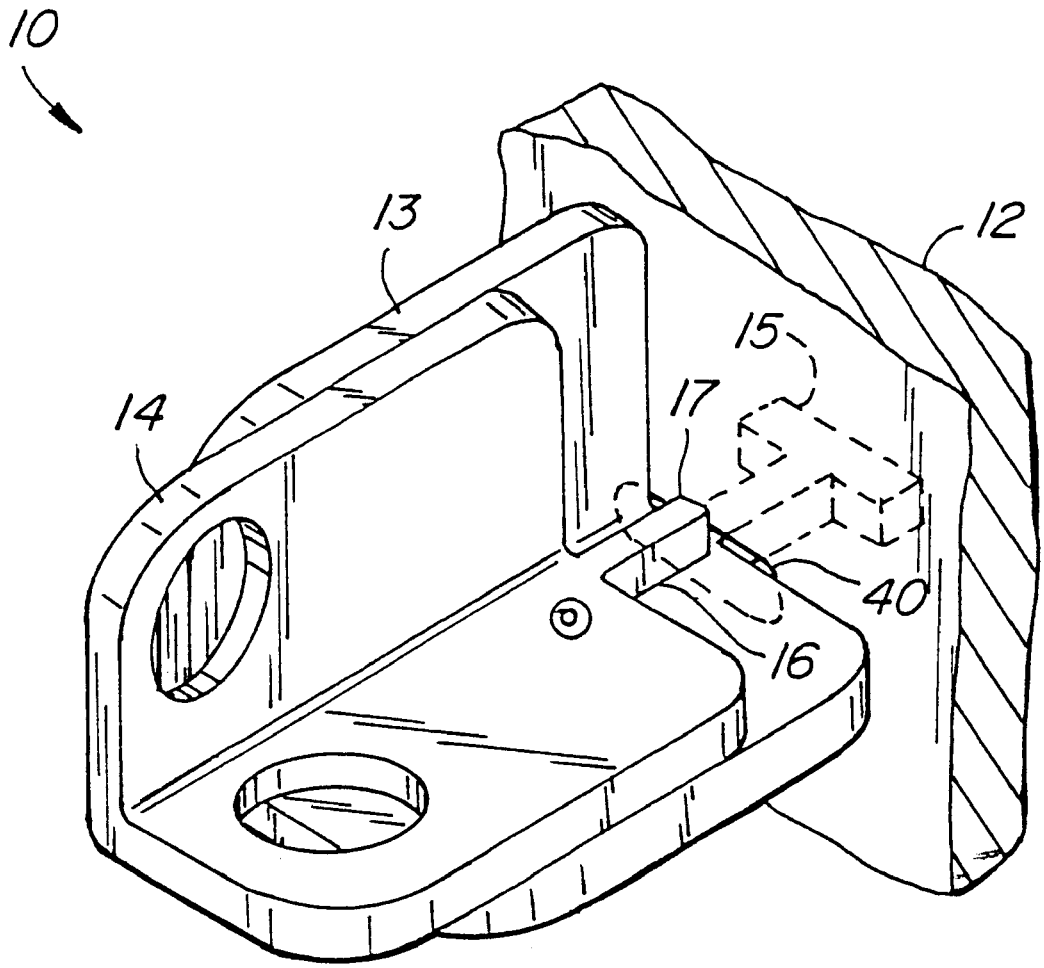
FIG. 2 is a perspective view of the locking apparatus illustrated in FIG. 1 engaging the security slot.
Figure 3:
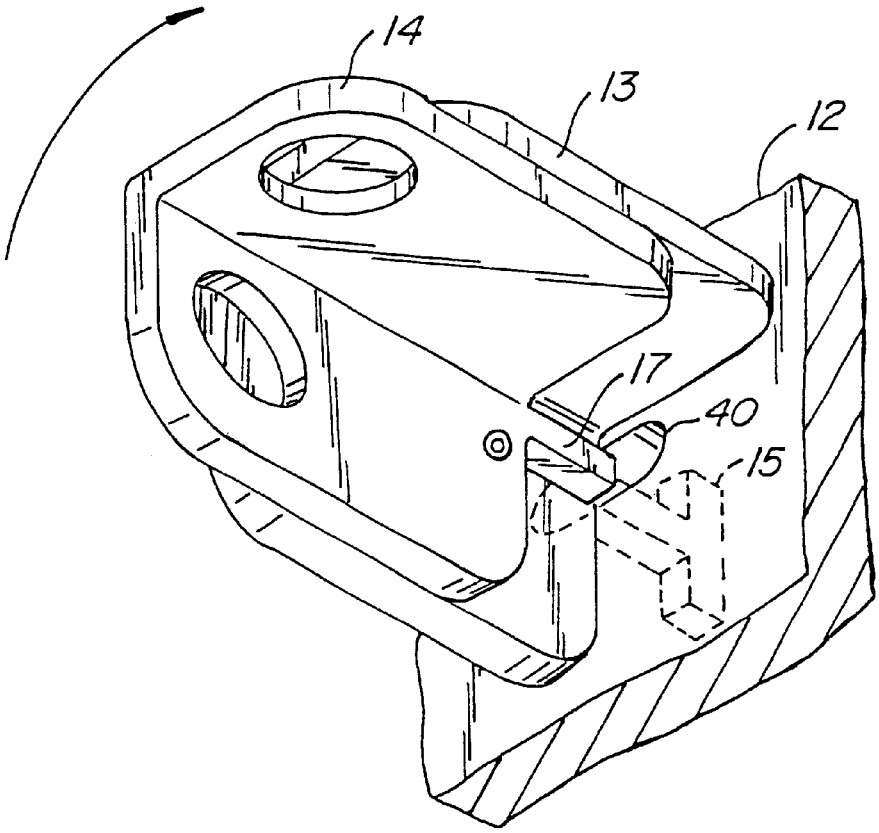
FIG. 3 is a perspective view of the locking apparatus illustrated in FIG. 2 and rotated 90°.

In use, the locking member is inserted into a slot 40 defined within an outer wall 41 of the device that one wishes to secure as can be seen in FIGS. 1 and 2. As can be seen in FIG. 3, the apparatus is rotated approximately 90°, and thus, the pin may now extend into the slot alongside the locking member. Because the locking member is substantially T-shaped, the locking member, in this rotated position, may not be removed from the slot.

Figure 6:
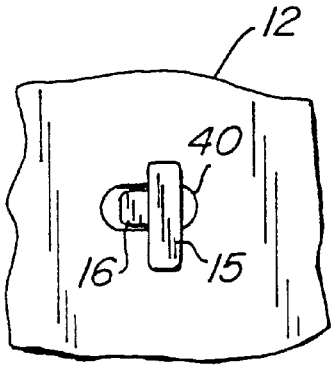
FIG. 6 is an elevation view of the locking member and pin engaging the security slot.
Figure 5:
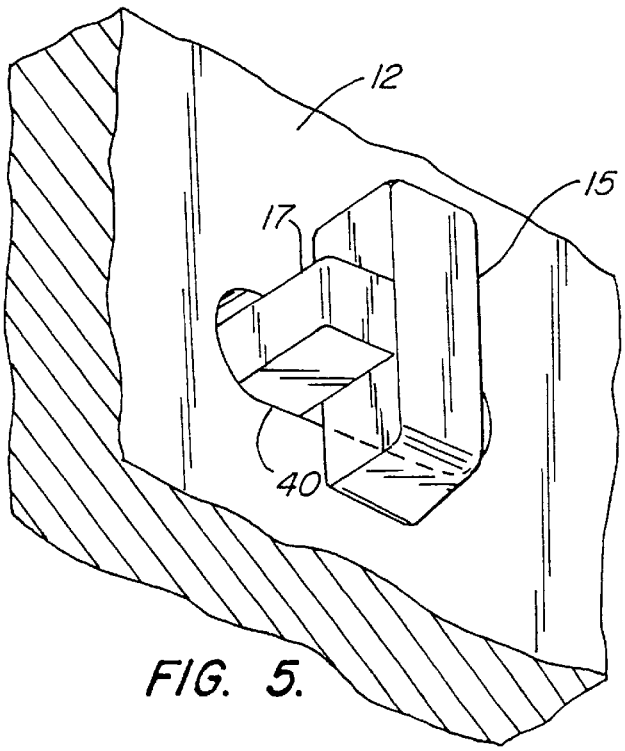
FIG. 5 is a perspective view of a locking member and a pin of the locking apparatus engaged in the security slot.

As can be seen in FIGS. 5 and 6, with the pin in the slot, the apparatus cannot rotate 90° to allow removal of the locking member from the slot. Thus, this position is a locked position.

Figure 4:
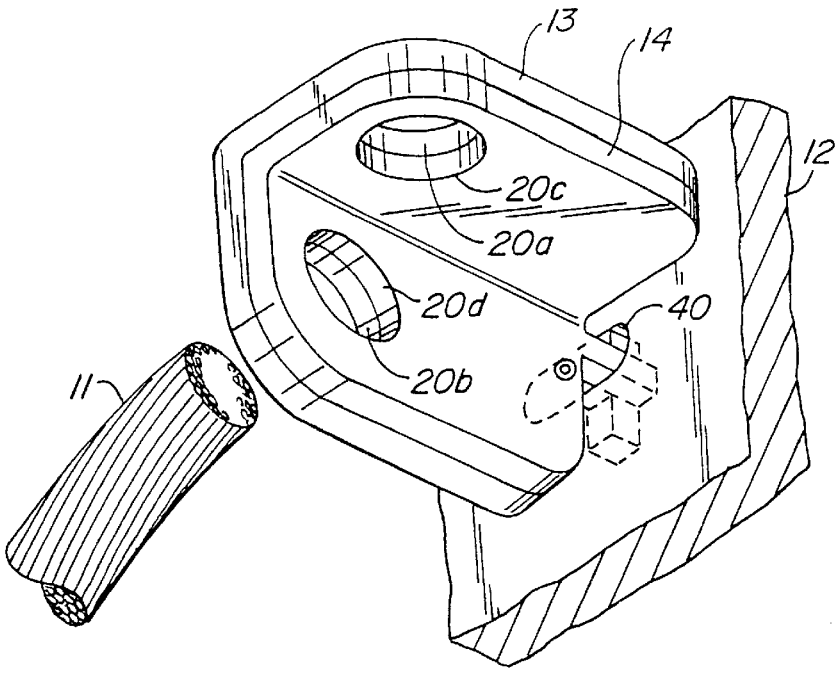
FIG. 4 is a perspective view of the locking apparatus illustrated in FIG. 3 in a locked position.

As can be seen in FIG. 4, by sliding the second member relative to the first member to insert the pin into the slot, the apertures are now aligned. A cable may be placed through the aligned apertures and the cable may be locked or secured to some type of somewhat stationary or large device such as a desk, a chair, cabinet, or even simply a ring coupled to a wall.

In the embodiment wherein the first and second members have a substantially 90° bend, because of the rotating of the device when it is in the locked position, there are two sets of aligned apertures to choose from for placing the cable. Thus, the cable may pass through two different directions 90° relative to one another. This eliminates problems associated with security slots that may be either vertically or horizontally oriented and cables or padlock shackles coming or going at odd angles.

Figure 15:
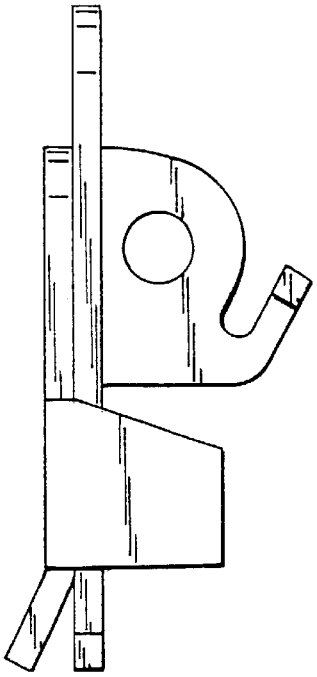
Figure 16:
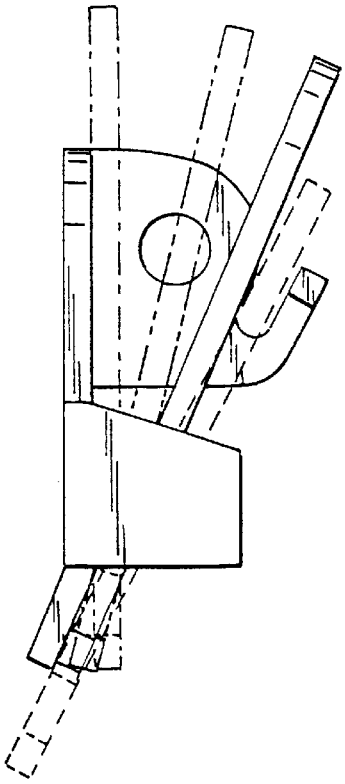
Figure 17:
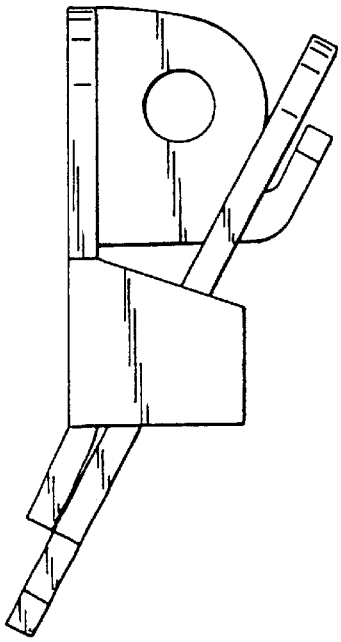

FIGS. 8–17 illustrate an alternative embodiment of a locking apparatus in accordance with the present invention. In the embodiment, the T-shaped locking member is inserted into a security slot while the locking apparatus is in a disengaged position as illustrated in FIG. 17. The locking apparatus is rotated 90 degrees and the T-shape of the locking member prevents removal of the locking member from the security slot. The locking apparatus is then moved into an engaged position as illustrated in FIGS. 15 and 16. This moves the pin away from the locking member as can be seen in FIG. 15, thereby preventing rotation of the locking apparatus because of interference of the locking member and the pin with the security slot.

Although the invention has been described with reference to specific exemplary embodiments, it will appreciated that it is intended to cover all modifications and equivalents within the scope of the appended claims.

What is claimed is:

1. An apparatus for securing a cable to a portable device equipped with a security slot in an outer wall, comprising:

a first member coupled to a second member, the first and second members having complementary shapes and having at least one aperture in a body portion of the respective first and second members;

a locking member protruding from a bottom edge of the first member;

a pin protruding from a bottom edge of the second member;

the first and second members being movable from an unlocked position wherein the locking member is adapted for insertion into the security slot and engagement with the outer wall, to a locked position wherein the pin slidably abuts the locking member to secure the locking member within the security slot, and the apertures align to provide a passage for the cable.

2. The apparatus as recited in claim 1 wherein the first member and the second member each have a first face and a second face with a generally right-angle fold therebetween, and wherein the second member slidably rests within the first member.

3. The apparatus as recited in claim 2 wherein each of the first and second faces of the first and second members includes an aperture, and wherein pairs of the apertures are configured to align in the locked position.

4. The apparatus as recited in claim 1 wherein the first member includes a channel, and the second member includes a rivet slidably arranged within the channel that attaches the second member to the first member.

5. A locking system, comprising:

a portable device having a wall defining a security slot a first member including a locking member protruding from a bottom edge thereof and a first aperture in a body portion thereof;

a second member connected with and complementarily shaped to the first member, including a pin protruding from a bottom edge thereof proximate the locking member and further including a second aperture in a body portion thereof;

a locking mechanism having a cross-sectional shape that fits within the first and second apertures;

the first and second members being movable from an unlocked position where the locking member is adapted for insertion into the security slot and engagement with the outer wall, to a locked position wherein the pin slidably abuts the locking member to secure the locking member within the security slot, and the apertures align to provide a passage for locking mechanism, and wherein threading the locking mechanism through the apertures secures the first and second members in the locked position.

6. The system as recited in claim 5 wherein the first member and the second member each have a first face and a second face with a generally right-angle fold therebetween, and wherein the second member slidably rests within the first member.

7. The system as recited in claim 6 further comprising a third aperture in the second face of the first member, and a fourth aperture in the second face of the second member, wherein the third and fourth apertures are provided at a generally right angle from the first and second apertures.

8. The system as recited in claim 6 wherein the first member includes a vertical channel, and the second member includes a rivet slidably arranged within the channel that attaches the second member to the first member.

9. The system as recited in claim 5 wherein the locking mechanism is a cable.

10. The system as recited in claim 5 wherein the locking mechanism is a padlock.

11. An apparatus for securing a cable to a portable device equipped with a security slot in an outer wall, comprising:

a first member connected with a second member, the first and second members having complementary shapes and having at least one aperture in a body portion of the respective first and second members, each body portion having a substantially 90° bend;

a locking member protruding from a bottom edge of the first member;

a pin protruding from a bottom edge of the second member;

wherein the first and second members are movable from an unlocked position wherein the locking member is adapted for insertion into the security slot and engagement with the outer wall to a locked position, wherein the pin slidably abuts the locking member to secure the locking member within the security slot, and the apertures align to provide a passage for the cable.

12. The apparatus as recited in claim 11 wherein the first member and the second member each have a first face and a second face with a generally right-angle fold therebetween, and wherein the second member slidably rests within the first member.

13. The apparatus as recited in claim 12 wherein each of the first and second faces of the first and second members includes an aperture, and wherein pairs of the apertures are configured to align in the locked position.

14. The apparatus as recited in claim 11 wherein the first member includes a vertical channel, and the second member includes a rivet slidably arranged within the channel that attaches the second member to the first member.

15. A locking system, comprising:

a portable device having a wall defining a security slot a first member including a locking member protruding from a bottom edge thereof and a first aperture in a body portion thereof, the body portion having a substantially 90° bend;

a second member connected with and complementarily shaped to the first member, including a pin protruding from a bottom edge thereof proximate the locking member and further including a second aperture in a body portion thereof, the body portion having a substantially 90° bend;

a locking mechanism having a cross-sectional shape that fits within the first and second apertures;

wherein the first and second members are movable from an unlocked position where the locking member is adapted for insertion into the security slot and engagement with the outer wall to a locked position, wherein the pin slidably abuts the locking member to secure the locking member within the security slot, and the apertures align to provide a passage for locking mechanism, and wherein threading the locking mechanism through the apertures secures the first and second members in the locked position.

16. The system as recited in claim 15 wherein the first member and the second member each have a first face and a second face with a generally right-angle fold therebetween, and wherein the second member slidably rests within the first member.

17. The system as recited in claim 16 further comprising a third aperture in the second face of the first member, and a fourth aperture in the second face of the second member, wherein the third and fourth apertures are provided at a generally right angle from the first and second apertures.

18. The system as recited in claim 16 wherein the first member includes a vertical channel, and the second member includes a rivet slidably arranged within the channel that attaches the second member to the first member.

19. The system as recited in claim 15 wherein the locking mechanism is a cable.

20. The system as recited in claim 15 wherein the locking mechanism is a padlock.

21. A method of securing a portable device equipped within a security slot defined within an outer wall of the portable device, the method comprising:

providing a locking apparatus comprising a first member coupled to a second member, the first and second members having complementary shapes and having at least one aperture in a body portion in the respective first and second members, a locking member protruding from a bottom edge of the first member, and a pin protruding from a bottom edge of the second member;

placing the locking member within the security slot;

rotating the locking apparatus 90°;

sliding the second member relative to the first member such that the pin is within the security slot and the apertures within the first and second members are aligned; and placing a locking device within the aligned apertures.

22. An apparatus for securing a cable to a portable device equipped with a security slot in an outer wall, comprising:

a first member coupled to a second member, the first member having at least one aperture defined in a body portion;

a locking member protruding from a bottom edge of the first member;

a pin protruding from a bottom edge of the second member, the pin defining an obtuse angle with respect to the second member;

the first and second members being movable from an unlocked position wherein the pin abuts the locking member and the locking member and pin are adapted for insertion into the security slot and the locking member is adapted for engagement with the outer wall, to a locked position wherein the pin defines an acute angle with respect to the locking member to secure the locking member within the security slot.

* * * * *